US005319167A

United States Patent [19]

Juds et al.

[11] Patent Number: 5,319,167

[45] Date of Patent: Jun. 7, 1994

[54] ELECTRICAL CONTACTOR EMPLOYING A ROTARY DISC

[75] Inventors: Mark A. Juds, New Berlin; Bruce C. Beihoff, Wauwatosa; Richard G. Smith, Caledonia; William R. Nelson, Waukesha; Daniel A. Wycklendt, Milwaukee; Peter J. Theisen, West Bend; Jerome K. Hastings, Sussex; Peter K. Moldovan, Cascade, all of Wis.

[73] Assignee: Eaton Corporation, Cleveland, Ohio

[21] Appl. No.: 27,971

[22] Filed: Mar. 8, 1993

[51] Int. Cl.[5] ..... H01H 33/02

[52] U.S. Cl. ..... 200/144 R

[58] Field of Search ..... 200/11 R-11 TW, 200/144 R, 150 C, 237-261, 275, 28, 286-288; 335/16, 147, 195

[56] References Cited

U.S. PATENT DOCUMENTS 5,072,081 12/1991 Sepelak ..... 200/144 R

*Primary Examiner*—J. R. Scott

*Attorney, Agent, or Firm*—L. H. Uthoff, Jr.

[57] ABSTRACT

An electrical contractor device (80) for controlling the flow of electrical power from a source of electrical power to an electrical device according to a command signal from a controller utilizing a rotary disc assembly (90) rotated by an actuator (169) where the rotary disc assembly (90) is comprised of a rotary disc (100) supporting a disc conductor (102) having a pair of contact pads (106, 108) joined by a pair of conductor legs (109, 113) and a center section (111) where the conductor legs (109, 113) are parallel and offset one from the other straddling an axis of rotation (103) where high flow of electrical current through the disc conductor (102) generates an electro-magnetic torque in the rotary disc assembly (90). The disc contacts (106, 108) make electrical contact with a corresponding number of stationary contacts (110,112) of a "turn back" design one of which is connected one to a source of electrical power and the second to the device whose operation is to be controlled were as the rotary disc (100) is rotated by the actuator means (169), the disc contacts (106, 108) make electrical connection with the stationary contacts (110, 112) and when the actuator (169) is not energized a return spring (176) causes the rotary disc (100) to rotate in an opposite direction thereby causing the stationary contacts (110, 112) to be forced away from the rotary disc (100) by a separation ramp (140, 142). A disc conductor (102) is formed to induce a rotary torque in the rotary disc (100) when an abnormally high electrical current is conducted thereby breaking the conduction path by rotating the rotary disc (100) in conjunction with the return spring (176) to overcome the spring (180) connecting actuator (169) and open the contactor device (80).

16 Claims, 4 Drawing Sheets

FIG 5
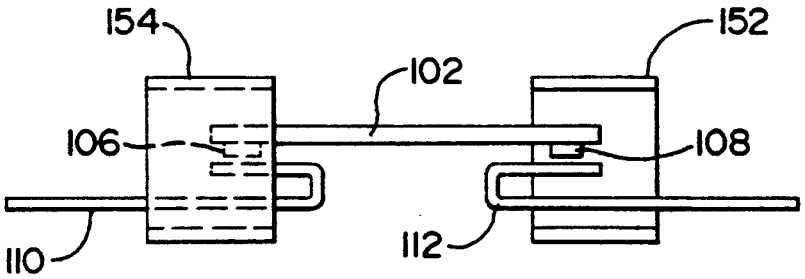
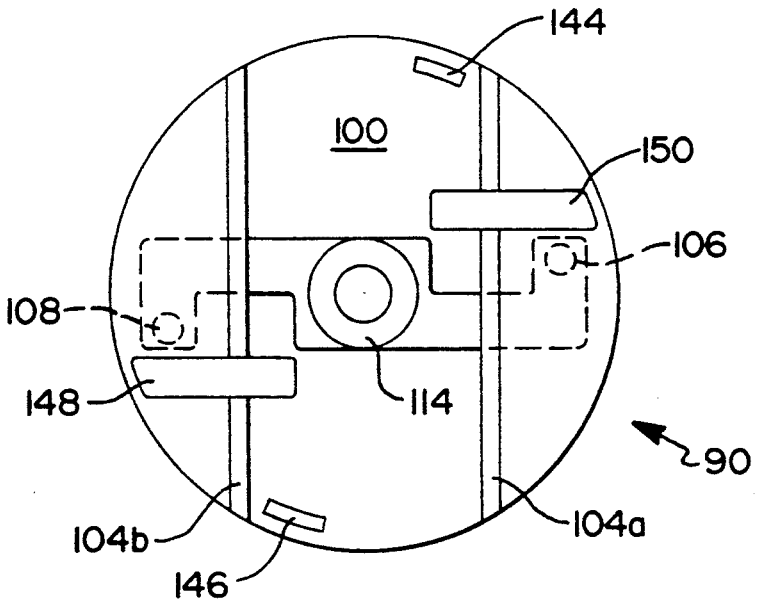
FIG 6

FIG 7
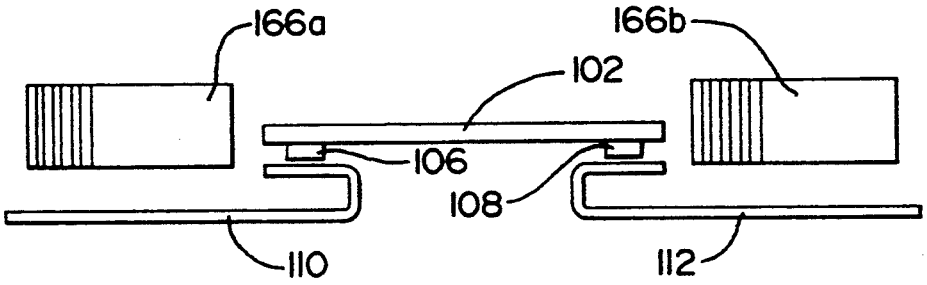
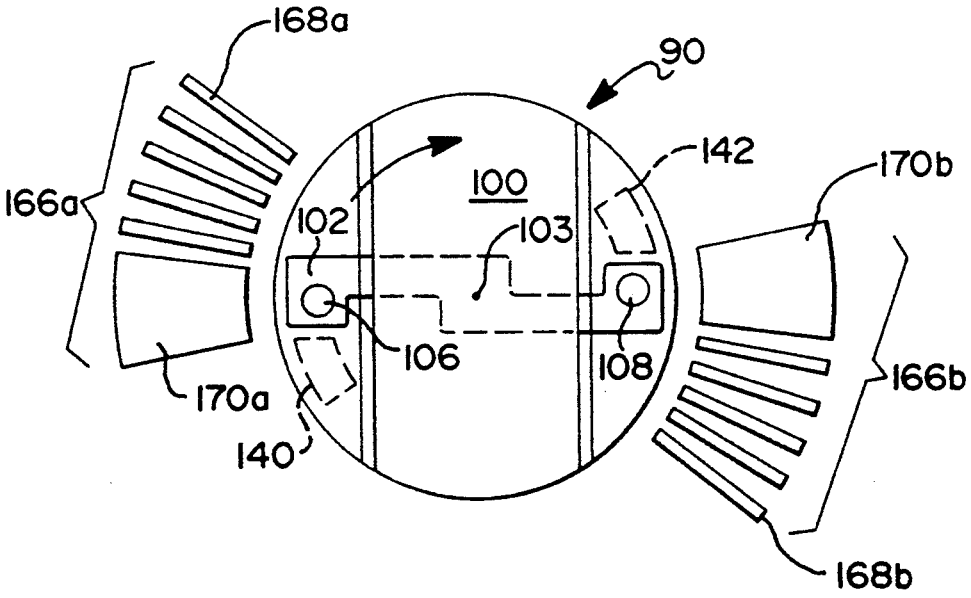
FIG 8

ELECTRICAL CONTACTOR EMPLOYING A ROTARY DISC

RELATED APPLICATION

This application relates to application U.S. Ser. No. 08/027,972 filed on Mar. 8, 1993, the same day as this application, entitled Electrical Contactor and Interrupter Employing a Rotary Disc and assigned to the same assignee, Eaton Corporation, as this application.

FIELD OF THE INVENTION

This invention relates to an electrical contactor for controlling the flow of electrical power to a device such as a motor. More specifically, this invention relates to an electrical contactor for normal electrical power that can be initiated or terminated using a pair of electrical contacts with one side of the pair mounted to a rotary disc powered by an actuator having a contact separation ramp and an arc suppressor and a second side connected to a source of electrical power and an electrical device.

DESCRIPTION OF THE PRIOR ART

Various types of electrical contactor systems are well known in the art and generally function to open or close at least one electrical contact for controlling the flow of electrical power from an electrical supply to some type of electrical or electro-mechanical device such as a motor. The purpose of the electrical contactor is to allow for either manual or automatic control of the electrical device so that its operation can be stopped and started either in normal operation or during abnormal operation where the supply of electrical current is controlled by the action of an electrical contactor which naturally opens and terminates flow of electrical power into the electrical device, is closed by an actuator to allow the flow of electrical power through the contactor according to commands received from some type of controller such as a microprocessor.

Common prior art methods of accomplishing the initiation or termination of electrical power flow employ a variety of mechanical mechanisms which are commonly spring loaded to force a pair of electrical contacts either closed or open to "make" or "break" an electrical circuit where the spring and mechanism is specifically designed to yield a force versus time history to minimize contact bounce upon closure thereby improving the life of the contacting elements. The mechanical mechanism is commonly controlled by operation of a manual switch which is moved to an "on" position or to an "off" position which causes the electrical contactor to close or open thereby "making" or "breaking" the electrical circuit. Usually the action of the manual switch is designed to be abrupt with a somewhat high actuation force required to move from the "on" to the "off" position or visa versa.

Various types of arc suppression devices are used to provide for the dissipation of the electrical energy caused by the arching between the contacts when the electrical contactor is opened or closed. These arc suppression devices include slot motors and arc plates which provide for an alternative path of electrical energy flow away from the contacts for movement and dissipation of the arc energy to improve the life and operation of the contacting elements.

With the recent expansion and use of microprocessors for control of various electrical devices in commercial and industrial environments, it is desirable to provide some type of electrical contactor which can be controlled electronically to provide the switching of high currents into various electrical devices particularly for performing manufacturing or commercial operations. This desired microprocessor controlled operation precludes the use of a prior art manually thrown on/off switch with its attendant high actuation forces.

It will be desirable to have an electrical contactor which would provide for the switching of normal currents according to a command received from a microprocessor-based control system where the contactor is energized into a conducting situation by some type of electro-mechanical actuator and then returned to a non-energized position by action of a mechanical return spring. Thus, the failsafe position would be in a non-contacting configuration for safety purposes. It would also be desirable to design a contactor that would use electromagnetic forces generated when abnormally high currents are encountered to assist in forcing the contacts open so as to disconnect a source of electrical power from a device whose operation is to be controlled.

SUMMARY OF THE INVENTION

The present invention provides for the use of an electronically (and/or manual) controlled actuation device especially for remote control by an electrical control signal which could be generated from a microprocessor-based controller which acts upon one or more rotary discs connected in series having electrical contacts thereon rotating so as to make or break an electrical power circuit for connecting a power supply to some form of electrical device such as a motor. With use of the present invention an advanced electronic controller such as a microprocessor can be used to control the flow of electrical current from a power supply to one or more electrical devices where the actuation of the electrical contactor is effectuated by a signal from the microprocessor-based controller to the electronic actuator which in turn rotates the rotary disc with one or more contacts mounted thereon which correspond to a like number of stationary contacts to provide for the making or breaking of the electric circuit as opposed to prior art methods of manual actuation.

With use of the present invention, normal operating currents can be electronically switched from a "on" to a "off" position or visa versa with good contact life by using a rotary disc having at least one contact mounted thereon which is located adjacent to and works in conjunction with a separation ramp mounted on the rotary disc which, when the electrical circuit is to be opened, one of the stationary contacts is engaged by the separation ramp thereby forcing the stationary contact away from the disc contact.

According to another aspect of the invention, the geometry of the disc contacts and the stationary contacts make use of the electro-magnetic forces generated by high current flows to force the contacts apart and also create a rotary torque which tends to rotate and assist the spring in rotating the disc into a non-contact non-conducting position where the stationary contact is forced away from the disc contact by the separation ramp and the stationary contact is shaped into what is known in the art as a "turn-back" conductor so that the flow of high current will tend to force the disc conductor away from the stationary conductor.

The disc conductor attached to the rotary disc upon which the contacts are mounted is shaped in the form of a "Z" to provide for a rotary torque upon introduction of a high electrical current which tends to assist the disc return spring in rotating the contact disc to open the contact pairs.

A variety of arc suppression devices can be incorporated and used with the present invention to dissipate the electrical arc generated from the contacts of the rotary disc as they are opened and closed. The purpose of the arc suppression device is to improve operation of the contacts during the making or breaking by dissipating the arc generated when the conducting surfaces contact one another and mechanically bounce on closure or simply create an arc upon opening. The arc energy is diverted away from the contacts into the arc suppressor. The present invention also discloses a method of arc suppression wherein a section of steel is embedded in the rotary disc in close proximity and on the opposite side of the disc contact which assists diverting of the electrical energy generated by the arc when the disc contact engages or disengages the stationary contact.

One provision of the present invention is to provide a method of electronically controlling a contactor for the switching of electrical power from an electrical power supply to an electrical device.

Another provision of the present invention is use a separation ramp to mechanically force a disc contact away from a corresponding stationary contact.

Another provision of the present invention is to position a metal plate in close proximity to a disc contact to assist diverting of the arc energy generated when the contacts make and break.

Another provision of the present invention is to use a turn-back conductor in conjunction with a separation ramp to move a disc contact away from a stationary contact.

Another provision of the present invention is to provide for a method of separating a moving contact from a stationary contact for more reliable switching with improved operation.

Another provision of the present invention is to provide for the interruption of electrical power flow when an abnormally high current is encountered by shaping a disc conductor to make use of the electro-magnetic forces generated by high electrical current to assist in the opening of an electrical contact by a rotation motion.

Another provision of the present invention is to provide for the suppression of the arc generated when a moving contact engages a stationary contact or visa versa where the moving contact is mounted on a rotary disc.

Still another provision of the present invention is to provide for the switching of electrical power flow from an electrical power supply to one or more electrical devices using a plurality of parallel connected rotary discs having electrical contacts mounted thereon and rotated simultaneously by an electro-magnetic actuator.

BRIEF DESCRIPTION OF THE DRAWINGS

FIG. 5 is a top plan view of the rotary disc and the stationary contacts of the electrical contactor of the present invention with a pair of slot motors covering the disc contact and the stationary contact;

FIG. 6 is a side elevational view of the rotary disc of the electrical contactor of the present invention with embedded metal plates;

FIG. 7 is a top plan view of the rotary disc, stationary contacts and plate arc suppressors of the electrical contactor of the present invention; and FIG. 8 is a side elevational view of the rotary contactor and plate arc suppressors of FIG. 7 of the electrical contactor of the present invention.

DETAILED DESCRIPTION OF THE PREFERRED EMBODIMENTS

Figure 1:
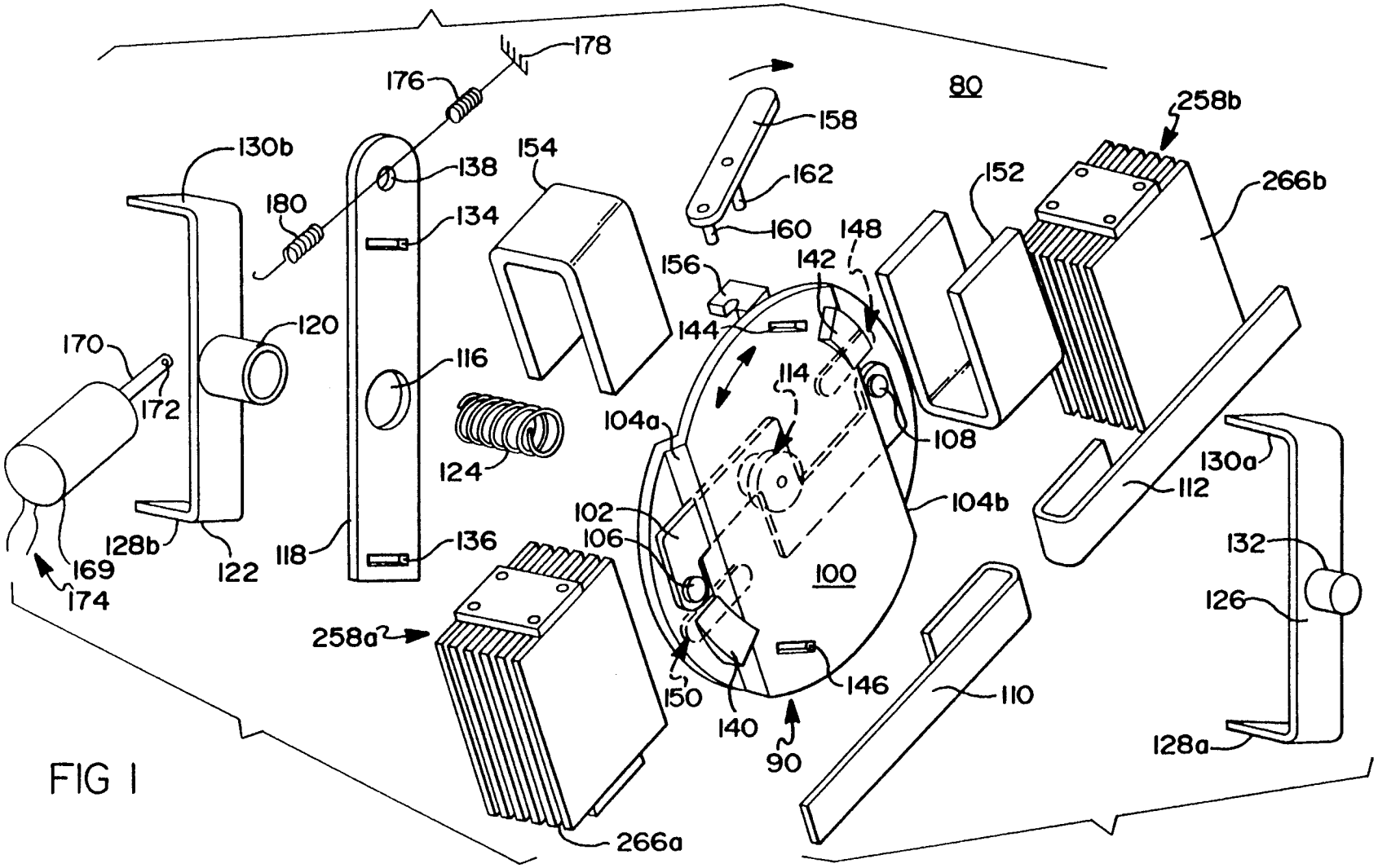
FIG. 1 is an exploded perspective view of the electrical contactor of the present invention.

Certain terminology will be used in the following description for convenience and reference only and will not be limiting. The words "upwardly", "downwardly", "rightwardly", "leftwardly", "clockwise" and "counterclockwise" will designate directions in the drawings to which reference is made. The words "inwardly" and "outwardly" will refer to directions toward and away from, respectively, the geometric center of the device and designated parts thereof. Such terminology will include the words above specifically mentioned, derivatives thereof, and words of similar import.

FIG. 1 is an exploded perspective view of the electrical contactor 80 of the present invention. The basic element of the electrical contactor 80 is a rotary disc assembly 90 which is caused to rotate when the electrical contactor 80 is commanded to either make or break the electrical connection which allows electrical power to flow from a power source to an electrical device neither of which are shown in the drawings. The electrical contactor 80 can consist of a plurality of rotary disc assemblies 90 which are mechanically connected in a parallel manner thereby providing for the simultaneous making or breaking of a plurality of electrical connections to control a variety of electrical devices.

By using the electrical contactor 80 of the present invention, an electronic control signal generator such as a microprocessor-based controller (not shown) can be used to signal the electrical contactor 80 of the present invention to either make or break an electrical circuit thereby allowing electrical power to flow from one electrical device to another or in the alternative to terminate the flow of electrical energy between the power source and the devices.

A unique design is used for a disc conductor 102 which functions to provide an electro-magnetically induced torque whenever a high electrical current flows through the disc conductor 102 where the disc conductor 102 is mounted to a rotary disc 100 which is rotatably supported to a support frame (not shown) by the center pivot 114. The disc conductor 102 supports the left disc contact 106 at one end and the right disc contact 108 at a second end. When the rotary disc 100 is in a given rotary position, the left disc contact 106 is in substantial alignment and comes into electrical contact with the left stationary contact 110 which is supported by the frame. Likewise the right disc contact 108 is in substantial alignment and comes into electrical contact with the right stationary contact 112 which is also supported by the frame when the rotary disc 100 is in a specified range of rotary position an electrical current is allowed to flow through the left stationary contact 110 into the left disc contact 106 travelling through the disc conductor 102 into the right disc contact 108, and into the right stationary contact 112 which is connected to an electrical device which is to be controlled. When the rotary disc 100 is in another rotary position neither the left or the right stationary contacts 110, 112 are in contact with the left or right disc contacts 106, 108 so that no electrical power flows through the electrical conductor 80.

The rotary disc assembly 90 is rotatably supported to the frame by a pair of fork couplings an inner fork coupling 122 and an outer fork coupling 126 where the inner fork coupling 122 has a coupling pilot 120 mounted thereto which rotatably engages the center pivot 114 allowing for the rotary disc assembly 90 to axially move inward and outward where a spring 124 sits between the inner fork coupling 122 in the center pivot 114. A lever 118 is connected to the rotary disc assembly 90 by way of the outer fork coupling 126 and functions as a point of connection for attachment of the output of some form of actuation device. The center pivot 114 is non-rotatably attached to the rotary disc 100 such that the total effect is to spring load (force) the disc assembly 90 away from the inner fork coupling 122. Also making up the support assembly for the rotary disc 100 is the outer fork coupling 126 which includes an outer fork **128*a* and an outer fork 130*a* where the outer fork 128*a* engages and passes through a disc fork slot 146 and engages and passes through a fork slot 136 in the lever 118 and overlaps and is mechanically attached to the inner fork 128*b* which is part of the inner fork coupling 122. Likewise, the outer fork 130*a* engages and passes through a disc fork slot 144 found in the rotary disc 100 and engages and passes through the fork slot 134 found in the lever 118 and overlaps and is mechanically attached to an inner fork 130*b* which is part of an inner fork coupling 122. The fork pivot pin 132 is supported in some type of bearing that is attached to the frame (not shown) so that the outer fork coupling 126 is allowed to rotate relative to the frame. If another rotary disc is not to be joined in a parallel manner to control a second electrical circuit, then the inner fork coupling 122 functions similar to the outer fork coupling 126 and another bearing is mounted to the frame for rotatably supporting the inner fork coupling 122 with another fork pivot pin similar to fork pivot pin 132. If a second rotary disc identical to rotary disc 100 is to be used and controlled by the same actuator, the inner fork 128*b* and the inner fork 130*b* engage disc fork slots and disc slots of the second rotary disc (not shown) similar to disc fork slots 146 and disc slots 144. In a like manner, subsequent rotary discs can be added to control the conduction or non-conduction of electrical energy through a second left stationary contact to a second right stationary contact in a similar manner to the left and right stationary contacts 110, 112 where the collection of rotary discs are rotatably supported at one side by the fork pivot pin 132** and on a second side at the opposite end of the assembly by a similar fork pivot pin (not shown) which engages a second bearing structure anchored to the frame (not shown).

To prevent the rotary disc 100 from rotating from the off to the on position where current is not allowed to flow from the left stationary contact 110 through the disc conductor 102 to the right stationary contact 112 where both the left stationary contact 110 and the right stationary contact 112 are not in alignment with the left disc contact 106 or the right disc contact 108 respectfully, a stop lever 158 is used having a stop pin 160 and supported and rotatably supported by the frame by stop pivot 162 is used to engage the stop plate 156 which is mounted to the rotary disc 100. Specifically the stop lever 158 can be moved and rotates about the stop pivot 162 such that the stop pin 160 engages the stop plate 156 thereby preventing the rotary disc assembly 90 from rotating in a counterclockwise direction such that the left stationary contact 110 and the right stationary contact 112 remain separated from the left disc contact 106 and the right disc contact 108. Once the stop lever 158 is moved in the opposite direction thereby disengaging the stop pin 160 from the stop plate 156, the rotary disc assembly 90 is free to move either clockwise or counterclockwise as dictated by the electronic controller (not shown).

The left stationary contact 110 is held away from the rotary disc 100 by the separation ramp 140 and likewise the right stationary contact 112 is held away from the rotary disc 100 by the separation ramp 142. The separation ramp 140, is built into and lies on the outer surface of the rotary disc 100. A thin edge is mounted adjacent to the disc contact 106 and increases in thickness extending in a counterclockwise direction. Likewise, the second separation ramp 142, is used in conjunction with the disc contact 108 extending away from the disc contact 108 in a counterclockwise direction, and increasing in thickness. The purpose of the separation ramps 140, 142 is to push the stationary contacts 110, 112 away from the rotary disc 100 when the rotary disc 100 is in a clockwise position and no electrical power is transferred through the electrical contactor 80.

Whenever the left disc contact 106 or the right disc contact 108 either just come in alignment and in physical contact with the left stationary contact 110 or the right stationary contact 112 respectively or when the rotary disc assembly 90 is moving in the opposite direction, that being in a clockwise direction where the left disc contact 106 and the right disc contact 108 are just disengaging the left stationary contact 110 and the right stationary contact 112 respectively, an electrical arc is generated which can cause pitting and degradation of the performance and life of the contact materials. To direct the arc away from the contacting elements, a disc arc plate 148 is embedded or attached to the rotary disc 100 and located on the opposite side of the rotary disc 100 as the position of the right disc contact 108. Likewise, the disc arc plate 150 is mounted opposite to and just out of alignment with the left disc contact 106 where the disc arc plate 150 is displaced just slightly towards the separation ramp 140.

Both the disc arc plates 148 and 150 are made of a magnetically conductive material such as steel. Both disc arc plates are embedded and/or molded into the rotary disc 100 or can be attached thereto using an adhesive or other attachment methods. The rotary disc 100 is made of a material having insulating qualities with respect to the flow of electrical current. A commonly used material for the rotary disc 100 would be a Fiberglass, ceramic or phenolic or moldable polymer which would be molded or cut to the appropriate shape. Generally, conductors such as the left stationary contact 110 and the right stationary contact 112 and the disc conductor 102 are all made of a highly electrically conductive material such as copper or any other material having similar electrical characteristics. The left disc contact 106 and the right disc contact 108 are made of a special contact material which is highly conductive that can withstand arcing in a high current situation such as a silver based mixture of materials. The separation ramps 140 and 142 made of the same material as the rotary disc 100 or any other non-conductive type material, ideally with a low co-efficient friction when in contact with the left stationary contact 110 or the right stationary contact 112.

The spring 124 is compressed when the components of the electrical contactor 80 of the present invention are assembled such that the rotary disc assembly 90 is forced away from the coupling pilot 120 thereby forcing the rotary disc assembly 90 outward toward the left and right stationary contacts 110 and 112. The function of the spring 124 is to insure that electrical contact is made when the rotary disc assembly 90 is rotated to a position such that the left disc contact 106 and the right disc contact 108 come in contact and alignment with the left stationary contact 110 and the right stationary contact 112 respectively. The spring 124 is shown as a coil type spring commonly made of a steel material although other types of spring configurations could be envisioned which would generate a similar force to the rotary disc assembly 90.

To rotate the rotary disc assembly 90, an actuator 169 is attached to the lever 118. The actuator 169 would be mounted with some type of mounting hardware to the support frame in a manner providing for a reaction force when the actuator 169 is energized to be absorbed by the support frame. The actuator 169 moves an actuator plunger 170 inward and outward in an axial fashion upon introduction of a control signal to the actuator input leads 174. The actuator plunger 170 is attached to the lever 118 by way of an actuator spring 180 where one end of the actuator spring 180 is attached to the lever 118 and the opposite end of the spring 180 is attached to the actuator plunger 170 by way of engaging a plunger hole 172. Thus, when the actuator 169 is electrically activated by the electronic controller, the actuator plunger 170 moves outward towards the body of actuator 169 thereby imparting a force acting through the actuator spring and into the lever 118 which causes the rotary disc assembly 90 to be rotated in a counterclockwise direction which brings the left and right disc contacts 106 and 108 into alignment with the left and right stationary contacts 110 and 112 whereupon electrical current is allowed to flow from the left stationary contact 110 through the disc conductor 102 and to the right stationary contact 112 or visa versa. The actuator spring 180 allows the lever 118 to be moved opposite to the motion imported by the actuator 169 and the conductor assembly 90 can be rotated to open the electrical circuit irrespective of the position of the actuator 169. This feature becomes very important when an overload current is encountered, since design features of the contactor assembly 90 induce a rotary torque in the rotary disc 100 which acts to rotate the disc assembly 90 in a clockwise direction and open the contacts. In a like manner, a plurality of rotary disc assemblies 90 could be duplicated and mechanically linked to control the flow of electrical current through a plurality of circuits.

A return spring 176 is also attached to the lever 118 with the other end of the return spring 176 attached to a mechanical ground 178 to the frame. The return spring 176 is in tension and acts to rotate the rotary disc assembly 90 in a clockwise direction such that the left stationary contact 110 engages the separation ramp 140 and likewise the right stationary contact 112 engages the separation ram 142 thereby preventing flow of electrical current from the left stationary contact 110 to the right stationary contact 112. This occurs when the actuator 169 is not energized and tends to occur whenever a high current is introduced into the disc conductor 102.

Other arc suppression devices that are also shown in FIG. 1 include the slot motors 152 and 154 and the arc suppression plate assemblies **258*a* and 258*b*** which will be discussed in more detail infra.

Figure 2:
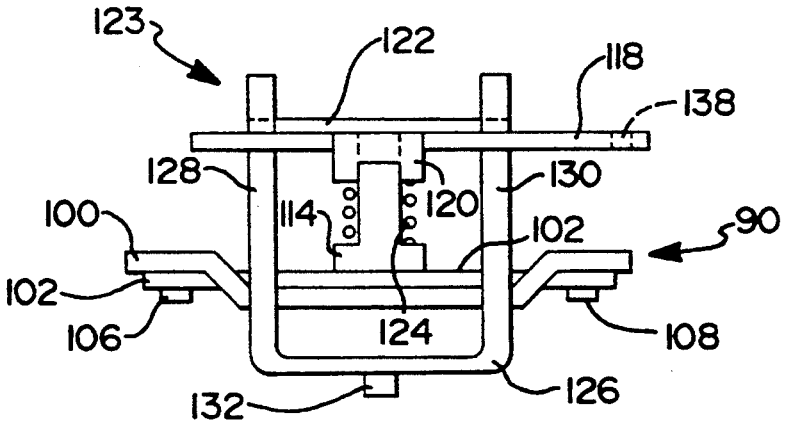
FIG. 2 is a top plan view of a section of the electrical contactor of the present invention showing the rotary disc mounted to the fork mechanism.

Now referring to FIG. 2, a top plan view of the rotary disc assembly 90 is shown mounted to the support framework 123 which includes the outer fork coupling 126 and the inner fork coupling 122. FIG. 2 shows how the rotating assembly which includes te rotary disc assembly 90, is mounted to the support framework 123 and spring loaded by spring 124 in a direction, which biases the rotary disc assembly 90 away from the lever 118. The spring 124 is shown in a state of compression and trapped around and between the center pivot 114 and by the end of the coupling pilot 120. Also clearly shown, is how the center pivot 114 is slidably supported by the coupling pilot 120 such that the rotary disc assembly 90 is supported both by the outer fork coupling 126 (by the outer fork **128*a* and the outer fork 130*a* and supported also by the engagement of the center pivot 114 with the coupling pilot 120. The coupling pilot 120 is attached to the inner fork coupling 122. The sliding engagement of the center pivot 114 with the coupling pilot 120 allows the rotaroy disc assembly 90 to move inwardly or outwardly due to the spring 124 force according to that required to load the left disc contact 106 and the right disc contact 108 against the left and right stationary contacts 110 and 112** respectively.

When the actuator 169 is energized a pulling force is applied to the lever 118 causing the disc to rotate counterclockwise and thereby allowing electrical current to flow through the disc conductor 102. When the actuator 169 is not energized, the return spring 176 pulls the rotary disc assembly clockwise and breaks the flow of electrical power through the contacts 106, 108, 110 and 112.

If only one rotary disc assembly 90 is to be used, another rotary support must be provided similar to that shown as fork pivot pin 132 on the opposite side of the device on the inner fork coupling to provide for rotation supported by bearings attached to the support frame allowing the assembly to rotate with respect thereto.

Also clearly shown in FIG. 2 is the relationship of the disc conductor 102 to the rotary disc 100 where the rotary disc 100 has disc folds **104*a* and 104*b* which allows the disc conductor 102 to substantially lie on the inward side of the rotary disc 100 in the center section and then to pass through slots cut in the disc folds 104*a* and 104*b* to allow the rotary disc conductor 102 to pass through and lie on the outward side of the rotary disc 100 where the left and right disc contacts 106 and 108 are mounted. This configuration provides for a more stable mechanical arrangement for function and support of the device especially the rotary disc assembly 90**.

Figure 3:
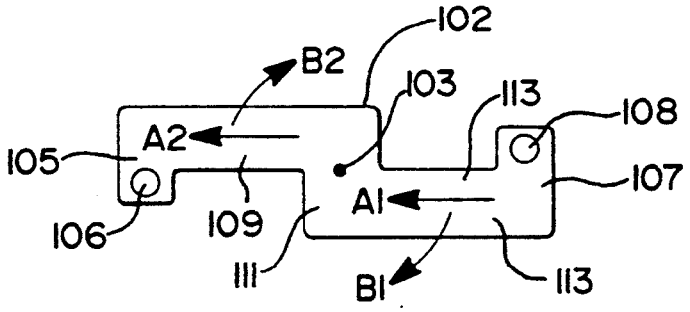
FIG. 3 is a side elevational view of the disc conductor and disc contacts of the electrical contactor of the present invention.

Now referring to FIG. 3, a side elevational view of the disc conductor 102 is shown with the electro-magnetic forces that are induced when a electrical current flows therethrough from the right disc contact 108 to the left disc contact 106.

The disc conductor 102 is comprised of a left contact pad 105 on which the left disc contact 106 is mounted. The left contact pad 105 is basically perpendicular to the left conductor leg 109 which extends and is connected to a center section 111 which is basically perpendicular both to the left conductor leg 109 and a right conductor leg 113. The left conductor leg 113 is parallel to the right conductor leg 109, however, the left conductor leg 109 lies above the axis of rotation 103 and the right conductor leg 113 lies below the axis of rotation 103. The right contact pad 107 then extends upward from the right conductor leg 113 upon which the right disc contact 108 is mounted. In the embodiment shown in FIG. 3, the left and right disc contacts are on a diametrical line passing through the axis of rotation 103.

The current induced electro-magnetic forces are labeled as B1 and B2 and are induced when an electrical current is passed from an electrical current source connected to the right stationary contact 112 and flows through the disc conductor 102 to the electrical device to be powered which is electrically connected to the left stationary contact 110. Due to the specific shape of the disc conductor 102 that being in the shape of a "Z" the electrical current B1 lies below that current labeled as C1, an electro-magnetic torque is induced due to the current generated electro-magnetic forces B1 and B2 acting at a distance from the rotary disc pivot 103. The torque developed by these forces tend to rotate the rotary disc assembly 90 in a clockwise direction. Torque B2 is the result of electro-magnetic interaction between currents A2 and C2. Torque B1 is the result of electro-magnetic interaction between currents A1 and C1. When the rotary disc assembly 90 is located in a clockwise direction, the left stationary contact 110 and the right stationary contact 112 are separated from the left disc contact 106 and the right disc contact 108 respectively, whereupon the electrical current no longer flows through the electrical contactor 80 of the present invention. Thus, when a very large current such as that produced by a short circuit is introduced to the electrical contactor 80 the specific shape and design of the disc contactor 102 produces a rotary torques B1 and B2 which tends to rotate the rotary disc assembly 90 clockwise so as to interrupt flow of electrical current.

Figure 4:
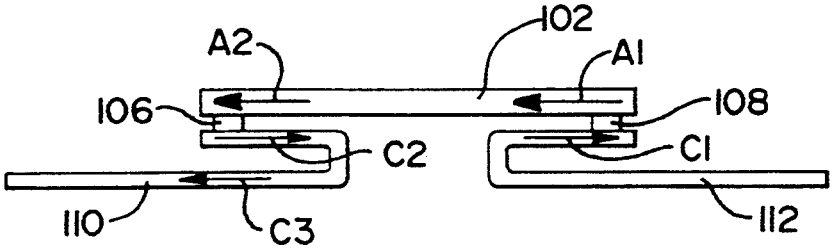
FIG. 4 is a top plan view of the rotary disc with the disc contacts mounted thereon showing the direction of current flow from the stationary contacts through the disc contacts and the disc conductor of the electrical contactor of the present invention.

FIG. 4 also shows other current induced electro-magnetic forces that are generated by the design of the left stationary contact 110 and a similar design of the right stationary contact 112 into a configuration known as a "turn back conductor". FIG. 4 is a top plan view of the disc conductor 102 when it is in electrical contact through the left and right disc contacts 106 and 108 with the left and right stationary contacts 110 and 112. Shown in FIG. 4 is the flow of electrical current from where the power supply is connected to the right stationary contact 112 and is shown as current arrow C1 whereupon it turns back and flows through the right disc contact 108 into the disc conductor 102 shown by current arrow A1 to the other side of the disc conductor 102 shown as current arrow A2 then through the left disc contact 106 and into the other turn back conductor labeled as left stationary contact 110 where the current in the contact is shown as current arrow C2 which "turns back" and flows in the opposite direction. The net effect of the turn back conductors 112 and 110 is to generate a force due to the flow of electrical current shown as C1 and C2 which tends to separate the left and right disc contacts 106 and 108 from their respective left and right stationary contacts 110 and 112 when a high current is introduced therein. This also assists in opening the electrical circuit of the electrical contactor 80 of the present invention to break the electrical path from the power source to the electrical device (not shown).

Whenever the electrical contacts make or break an electrical circuit, electrical energy is produced in the form of an electrical arc which flows between the contacts causing damage thereto. One method to dissipate and redirect such an electrical arc energy is shown in FIG. 5 where a right slot motor 152 and a left slot motor 154 are shown and envelope the electrical contacts, specifically the left and right disc contacts 106 and 108 and the left and right stationary contacts 110 and 112. The right and left slot motors 152 and 154 are formed into a "U" shape out of an electro-magnetically conductive material such as steel. The right and left slot motors 152 and 154 enhance the movement of the arc off of the contact pairs generated from the contact pairs making or breaking by increasing forces B1,B2,D1 and D2 and by moving the arc off the contacts faster thereby increasing contact life and enhancing overall performance.

Another method of redirecting the arc energy generated when the contact pairs make or break is shown in FIG. 6 which is a side elevational view of the rotary disc assembly 90 as viewed from the backside of the rotary disc assembly 90 shown in FIG. 1. As discussed supra, disc arc plates 148 and 150 are mounted to the rotary disc 100 and positioned on the opposite side of the rotary disc 100 as the disc contact 106 and the right disc contact 108. The disc arc plates 148 and 150 are radially separated from and in a same direction as, the stationary contacts 110 and 112 would move when the rotary disc assembly 90 is rotated in a clockwise direction so as to interrupt the flow of electrical current. In other words, the disc arc plates 148 and 150 are located approximately opposite the mounting position of the separation ramps 140 and 142. The function of the disc arc plates 148 and 150 are to enhance the movement of the arc off of the contact pairs formed when the contact pairs 112, 108 and 110, 106 make or break the flow of electrical current thereby improving the functional life and overall performance of the contacts.

Referring again to the electrical contactor 80 of the present invention shown in FIG. 1, another method of redirecting the flow of arc energy produced when the contact pairs 108, 112 and 106, 110 make or break is arc suppressor **258*a* and arc suppressor 258*b* which are placed immediately adjacent to the making or breaking contact pairs. The arc suppressors 258*a* and 258*b* are formed of a plurality of arc suppression plates 266*a* and 266*b* which are arranged in approximately parallel relationship one to the other and held together by some fastening means. The arc from the making or breaking contacts moves into the arc suppressors 258*a* and 258*b* thereby reducing damage to the contact pairs formed by the left and right disc contacts 106 and 108 contacting with the left and right stationary contacts 110 and 112** respectively. This method of channeling arc energy is well known in the art developed and widely used previous to this disclosure.

Another method that can be used either alone or in conjunction with those methods of arc control previously discussed is shown and discussed infra with reference to FIGS. 7 and 8. FIG. 7 is a top elevational view of the disc conductor 102 and the contact pairs 108, 112 and 106, 110 where an arc plate assembly 166*a* is placed immediately adjacent to the left disc contact 106 and the left stationary contact 110 and a second parallel arc plate assembly 166*b* is placed immediately adjacent to the right disc contact 108 and the right stationary contact 112.

Both the left and right arc plate assemblies 166*a* and 166*b* are more clearly shown in FIG. 8 where a side elevational view is shown of the rotary disc assembly 90 and the left arc plate assembly 166*a* and the right arc plate assembly 166*b*. The arc plate assemblies 166*a* and 166*b* are made up of a plurality of approximately parallel plates in two arc plate subassemblies, one for each contact pair one subassembly being known as the subassembly arc plates 170*a* and 170*b* which are made up of a plurality of approximately parallel plates lying in a common plane to that plane established by the rotary disc 100. A second subassembly of radial arc plates 168*a* and 168*b* are plates that have a longitudinal axis that lie along radial lines emanating from the pivot point 103 of the rotary disc 100 outwardly and each lie in an individual plane which is substantially perpendicular to those established by the subassembly arc plates 170*a* and 170*b*. Thus in this manner, the radial arc plates 168*a* and 168*b* establish individual planes substantially perpendicular to that established by the rotary disc 100.

The function of the left and right subassembly arc plates 170*a* and 170*b* and the left and right radial arc plates 168*a* and 168*b* is to split and cool the arc generated when the contacts 106 and 108 make or break an electrical current flow. The left and right subassembly arc plates 170*a* and 170*b* initially split and cool the breaking arc which then extends into the left and right radial arc plates 168*a* and 168*b* thereby providing a much more effective extinguishing of the arc than what would be possible with prior art technology using a plurality of parallel arc plates such as those found with the left and right parallel arc plates 170*a* and 170*b* are used alone. The arc plates are generally made of electrically and/or electro-magnetically conducting materials such as steel but other materials are contemplated and found in this field of use.

Although this invention has been described in its preferred embodiments with a certain degree of particularity, it is understood such descriptions are by way of example only, that certain modifications are possible within the spirit and scope of the invention as hereinafter claimed.

We claim:

1. An electrical contactor for connecting and disconnecting a source of electric power to an electrical device in response to an electronic control signal comprising:

actuator means for rotating an element of said electrical contactor in response to said electronic control signal;

a support frame for supporting components of said electrical contactor;

a rotary disc assembly rotatable about an axis of rotation comprising; a rotary disc having a front side and a back side, said rotary disc having a conductor element mounted thereon, said conductor element having a first end and a second end both exposed on said front side, a first disc contact mounted at said first end and a second disc contact mounted at said second end, said rotary disc assembly pivotably mounted to said support frame and mechanically connected to said actuator means for rotating said rotary disc, said rotary disc having a first separation ramp and a second separation ramp each positioned and extending from said first and said second disc contacts respectively, where said first and said second separation ramps have a relatively thin section adjacent to said first and said second disc contacts respectively, said first and second separation ramps increasing in section thickness along a path concentric to said axis of rotation, said conductor element extending downward from said first end, then extending along a first cord line lying below said axis of rotation of said rotary disc to said axis of rotation then extending upward above said axis of rotation, then extending along a second cord line lying above said axis of rotation, said second cord line parallel to said first cord line, and then extending downward and providing for the mounting of said second disc contact where said first disc contact and said second disc contact lie along a diametrical line of said rotary disc where said first cord line lies below said diametrical line and said second cord line lies above said diametrical line;

a first stationary conductor having a contactor portion in substantial alignment with said first disc contact and extending toward said axis of rotation then turning and extending away from said axis of rotation connected to a source of electrical power;

a second stationary conductor having a contactor portion in substantial alignment with said second disc contact and extending toward said axis of rotation then turning and extending away from said axis of rotation; and a return spring having a first end attached to said rotary disc and a second end attached to said support frame for forcing said rotary disc in a direction where said electrical power is disconnected from said electrical device.

2. The electrical contactor of claim 1, wherein said actuation means is mechanically attached to said rotary disc assembly by an elastic link for permitting said rotary disc to be moved independent of the position of said actuation means.

3. The electrical contactor of claim 1, wherein said rotary disc includes a first disc arc plate made of an electrically conductive material affixed to said back side of said rotary disc substantially opposite to said first disc contact and a second disc arc plate made of an electrically conductive material affixed to said back side of said rotary disc substantially opposite to said second disc contact.

4. The electrical contactor of claim 1, wherein said rotary disc assembly is forced toward said first stationary conductor and said second stationary conductor by a spring.

5. The electrical contactor of claim 1, wherein said rotary disc is supported on a framework, said framework slidingly engaging said rotary disc by passing through openings in said rotary disc, said framework rotatably mounted to said support frame along said axis of rotation of said rotary disc assembly, said actuator means being mounted to said support frame.

6. The electrical contactor of claim 1, wherein a plurality of said rotary discs are each supported on a framework, said framework slidingly engaging said rotary disc by passing through openings in said rotary disc, where said rotary discs are joined one to another in a parallel manner by attaching said frameworks one to another with said axis of rotation of each of said rotary discs lying along a common axis of rotation where the first and last of said rotary disc frameworks are rotatably mounted to said support frame at said common axis of rotation for connecting and disconnecting a corresponding number of electric circuits.

7. The electrical contactor of claim 1, wherein a first plurality of substantially parallel arc plates are located adjacent to said first disc contact and a second plurality of substantially parallel arc plates are located adjacent to said second disc contact.

8. The electrical contactor of claim 7, wherein said first plurality of substantially parallel arc plates have principal geometric planes parallel to said rotary disc and said second plurality of substantially parallel arc plates have principal geometric planes parallel to said rotary disc, and further comprising a third plurality of substantially parallel arc plates adjacent to said first plurality of substantially parallel arc plates, where said third plurality of substantially parallel arc plates have principal geometric planes perpendicular to said rotary disc and a fourth plurality of substantially parallel arc plates adjacent to said second plurality of substantially parallel arc plates where said fourth plurality of substantially parallel arc plates have principal geometric planes perpendicular to said rotary disc.

9. The electrical contactor of claim 1, wherein said first disc contact and said second disc contact are each enveloped by a slot motor having a continuous section of magnetically conductive material formed into a U like shape with a first side facing said front side of said rotary disc and with said first side also facing said back side of said rotary disc, a first slot motor positioned opposing said first disc contact and a second slot motor positioned opposing said second disc contact for arc suppression.

10. The electrical contactor of claim 1, wherein said rotary disc lies in two primary parallel planes, a first plane perpendicular to said axis of rotation of said rotary disc and parallel to a primary plane of said conductor element and disposed on a front side of said conductor element, and a second plane on which said first end and said second end of said conductive element lie, said second plane being parallel to said first plane and disposed to join a back side of said conductor element, said rotary disc having a first fold and a second fold by which said first plane is joined with said second plane and where a center section of said conductor element lies on said back side of said rotary disc and where said first end of said conductor element passes through a slot formed in said first fold and said second end of said conductor element passes through a slot formed in said second fold and where said first end and said second end, lie on said front side of said rotary disc and where said center section of said conductor element lies on said back side of said rotary disc.

11. A contact disc assembly for use in an electrical contactor device comprising:

a contact disc rotatable about an axis of rotation having a front side and back sides formed on an electrically nonconductive material.

a conductive member having a first end and a second end mounted to said contact disc comprising; a first contact pad located at said first end and a second contact pad at said second end, a front conductor leg extending from said first contact pad, a center section attached to said first conductor leg extending in a direction perpendicular to said first conductor leg and passing through said axis of rotation, a second conductor leg attached to said center section, when said second conductor leg is perpendicular to said center section and when said second conductor leg is parallel to said first conductor leg, a second contact pad attached to said second conductor leg;

a first separation ramp mounted to said front side of said contact disc adjacent to said first contact pad where said first separation ramp is oriented such that the thickness of the first separation ramp increases with increasing distance from said first contact pad; and a second separation ramp mounted to said front side of said contact disc adjacent said second contact pad where said second separation ramp is oriented such that the thickness of the second separation ramp increases with increasing distance from said second contact pad where said second separation ramp extends in an opposite circular direction to that of said first separation ramp.

12. The contact disc assembly of claim 11, wherein said center section is mounted on said back side of said contact disc and where said first contact pad and said second contact pad are mounted to said front side of said contact disc.

13. The contact disc assembly of claim 12, wherein a first arc plate is mounted on said back side of said contact disc approximately opposite to said first contact pad and a second arc plate is mounted on said back side of said contact disc approximately opposite said second contact pad for enhancing the motion of the arc away from said first and second contact pads.

14. The contact disc assembly of claim 12, wherein said contact disc has a first fold in said front side and a second fold in said front side where said first fold is parallel to said second fold and where said first fold lies on an opposite side and equidistance from said axis of rotation, where a second section of said rotary disc bounded by said first fold and said second fold is on a plane, and a section of said rotary disc separated by said first fold is on a common plane with a section of said rotary disc separated by said second fold where a first slot is forced in said first fold for allowing said first conductor leg to pass therethrough and a second slot is formed in said second fold for allowing said second conductor leg to pass therethrough.

15. The contact disc assembly of claim 11, wherein a first electrical contact is mounted to said first contact pad and a second electrical contact is mounted to said second contact pad.

16. The contact disc assembly of claim 11, wherein a rotary bearing member is mounted to said contact disc at said axis of rotation.

* * * * *